United States Patent [19]

Yamada et al.

[11] Patent Number: 4,602,544

[45] Date of Patent: Jul. 29, 1986

[54] PERFORMANCE DATA PROCESSING APPARATUS

[75] Inventors: Shigeru Yamada, Hamakita; Koichi Kozuki, Hamamatsu; Tatsuhiro Koike, Hamakita, all of Japan

[73] Assignee: Nippon Gakki Seizo Kabushiki Kaisha, Hamamatsu, Japan

[21] Appl. No.: 499,219

[22] Filed: May 31, 1983

[30] Foreign Application Priority Data

Jun. 2, 1982 [JP] Japan ..... 57-94456

[51] Int. Cl.[4] ..... G10F 1/00

[52] U.S. Cl. ..... 84/1.01; 84/1.03; 84/DIG. 12; 364/400

[58] Field of Search ..... 84/DIG. 12, 1.03, 1.01, 84/462, 477 R; 364/551, 900, 705

[56] References Cited

U.S. PATENT DOCUMENTS

| | | | |
|---|---|---|---|
| 4,022,097 | 5/1977 | Strangio | 84/DIG. 12 |
| 4,163,407 | 8/1979 | Solender | 84/DIG. 12 |
| 4,339,978 | 7/1982 | Imamura | 84/DIG. 12 |
| 4,344,344 | 8/1982 | Nakada et al. | 84/DIG. 12 |
| 4,345,501 | 8/1982 | Nakada et al. | 84/DIG. 12 |
| 4,454,796 | 6/1984 | Inoue et al. | 84/DIG. 12 |
| 4,485,716 | 12/1984 | Koike | 84/DIG. 12 X |
| 4,491,049 | 1/1985 | Mizuta et al. | 364/705 X |

*Primary Examiner*—Errol A. Krass
*Assistant Examiner*—Thomas G. Black
*Attorney, Agent, or Firm*—Spensley Horn Jubas & Lubitz

[57] ABSTRACT

Performance data is comprised of a successive serial arrangement of note data formed with paired pitch data and note duration data and of rest data formed with only rest duration data and having no pitch data. A performance data processing apparatus judges whether a rest datum following a note datum is shorter than a predetermined duration, and in case the result of this judgment if YES, the apparatus integrates the rest datum and the note datum preceding the rest datum into an integrated note datum having a note pitch of the note datum and a note duration which is equal to the sum of the duration of the note datum and the duration of the rest datum, whereby, in case a music score is displayed or printed out based on the performance data, rests having a duration shorter than the predetermined duration are eliminated to prolong the duration of the respective preceding notes each by an amount of the duration of the eliminated rest. Thus, there is obtained a music score having inscriptions similar to those of an ordinary music score, and also there can be reproduced a performance which is free of an unnatural sense.

11 Claims, 12 Drawing Figures

PERFORMANCE DATA PROCESSING APPARATUS

BACKGROUND OF THE INVENTION (a) Field of the Invention

The present invention relates to a performance data processing apparatus for processing, based on the performance data produced by playing a keyboard musical instrument such as an electronic musical instrument or a piano, said performance data in such fashion as to be able to be printed out or displayed in the form of, for example, a music score free from unnecessary rests.

(b) Description of the Prior Art

Attempts have been made, of late, to provide a keyboard musical instrument such as an electronic musical instrument or a piano with a performance data storing means to display or print out a music score or to realize an automatic playing on the musical instrument, based on the stored performance data.

However, in such conventional performance data processing apparatuses as mentioned above, the performance data of the playing has been faithfully stored, and the stored data has been reproduced faithfully also.

Now, in case a music score as shown in, for example, FIG. 1B is to be played, there arises, between the respective adjacent notes, a very trifle length of time in which the player's finger is detached from the depressed key. Especially, in case a music score carrying a series of notes of a same pitch appearing in a train is to be played on the keyboard instrument, the player will necessarily detach his finger off the pertinent depressed key once before starting another depression of this same key, and then he will again depress this same key again, and such key-depression and key-release actions will continue one after another in succession.

As such, when such performance data are faithfully stored, the respective short periods of time of key-releases occurring between respective adjacent notes will be stored, in fact, in the form of rests, respectively. Thus, the music score which is displayed or printed out based on the stored performance data will contain too many unnecessary rests. In case an automatic playing is carried out on such performance data, the reproduced sounds of the playing will become utterly unnatural.

SUMMARY OF THE INVENTION

It is a general object of the present invention to provide a performance data processing apparatus which solves the problems encountered conventionally as mentioned above, and which, at the time a music score is displayed or printed out based on the performance data obtained as a result of the playing of, for example, a keyboard musical instrument, the performance data is processed in such a way that no unnecessary rests will appear on the music score which is displayed or printed out.

A specific object of the present invention is to provide a performance data processing apparatus of the type as described above, which is effective in printing out or displaying a music score based on the performance data stored as a keyboard musical instrument-such as an electronic musical instrument, an electronic piano or a player piano is played, or in realizing an automatic playing of such musical instrument based on the processed performance data, and which is arranged so that those rests of very short durations existing between adjacent notes provided in a train of notes are eliminated so as to prolong the duration of the respective forward notes for an amount corresponding to the length of this short duration.

Another object of the present invention is to provide a performance data processing apparatus of the type as described above, which processes performance data in such way that no unnecessary rests will appear on the printed-out or displayed music score and that a music score carrying the inscriptions similar to an ordinary music score can be obtained.

Still another object of the present invention is to provide a performance data processing apparatus of the type as described above, which is arranged so that, in case an automatic playing of a keyboard musical instrument is realized based on the processed performance data, there can be reproduced a performance which is free of unnatural sounds for the listeners.

DETAILED DESCRIPTION OF THE PREFERRED EMBODIMENT

Figure 2:
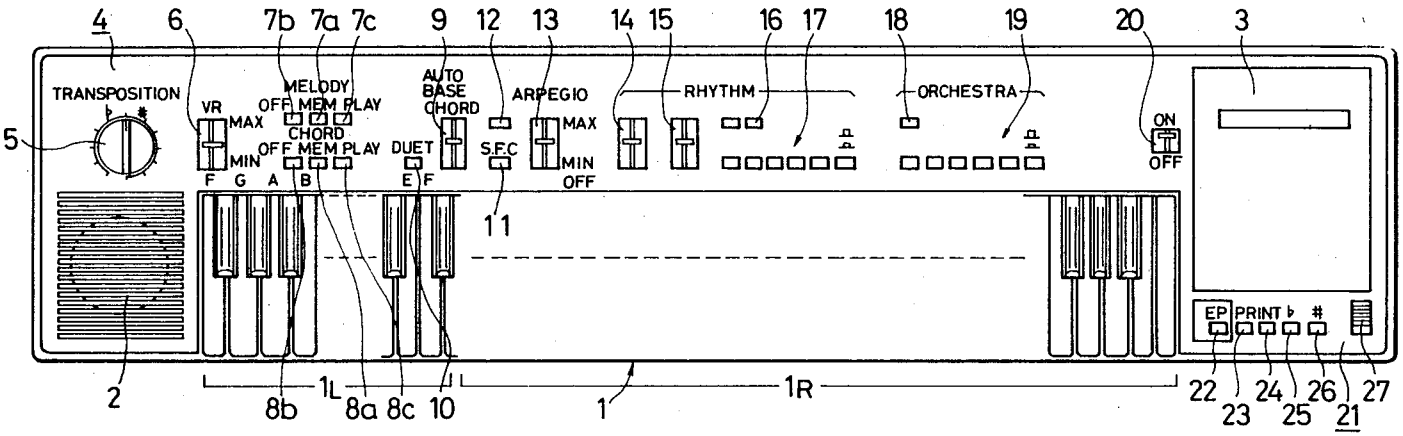
FIG. 2 is a diagrammatic plan view, showing an external appearance of a portable type keyboard electronic musical instrument equipped with a printer, as an embodiment of the present invention.

FIG. 2 shows an external appearance of a portable type keyboard electronic musical instrument equipped with a printer, as an embodiment of the present invention. On the upper side of the body of this instrument, there is provided a keyboard 1 comprised of a continuous serial arrangement of a right-fingers keyboard section 1R for melody playing and a left-fingers keyboard section 1L for chord playing; a loudspeaker 2 for generating a performance sound; and a printer 3 for printing out a music score.

And, on the panel face 4 located rearwardly of the keyboard 1 and the loudspeaker 2, there is provided a transposition selection knob 5, a master volume 6, a melody memory switch **7*a*, a melody memory off switch 7*b*, a melody play switch 7*c*, an autobase chord (called "ABC" briefly) memory switch 8*a*, an ABC memory off switch 8*b*, an ABC play switch 8*c*, an ABC volume 9, a duet sound adding duet switch 10, a single finger chord switch 11 to enable a chord playing by a key depression with a single finger on the left-fingers keyboard section 1L, a variation switch 12, an arpeggio volume 13 (when set to minimum, an arpeggio switch 13S which will be described later becomes deactuated), a rhythm volume 14 related to auto-rhythm playing, a tempo volume 15, a synchro-start switch 16, a rhythm selection switch group 17, a sustain switch 18 related to tone color and a tone-color selection switch group 19, and a power switch 20**.

Furthermore, on the panel face 21 on this side of the printer 3, there is provided an easy printing operation switch 22, a standby switch 23 for printing, a start/stop switch 24, a flat input switch 25, a sharp input switch 26, and a local-panel opening button 27.

Figure 3A:
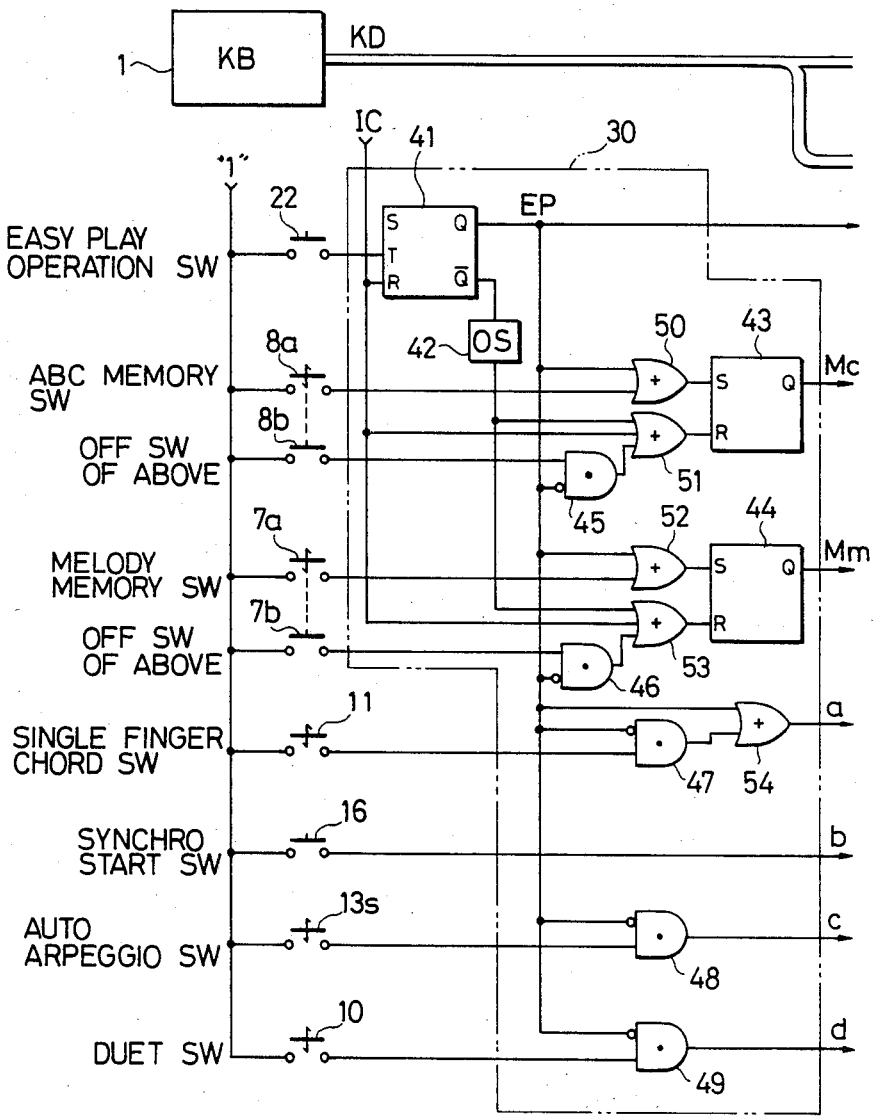
FIGS. 3A and 3B, in combination, are a block circuit diagram showing an overall outline of the circuit arrangement of said embodiment of FIG. 2.
Figure 3B:
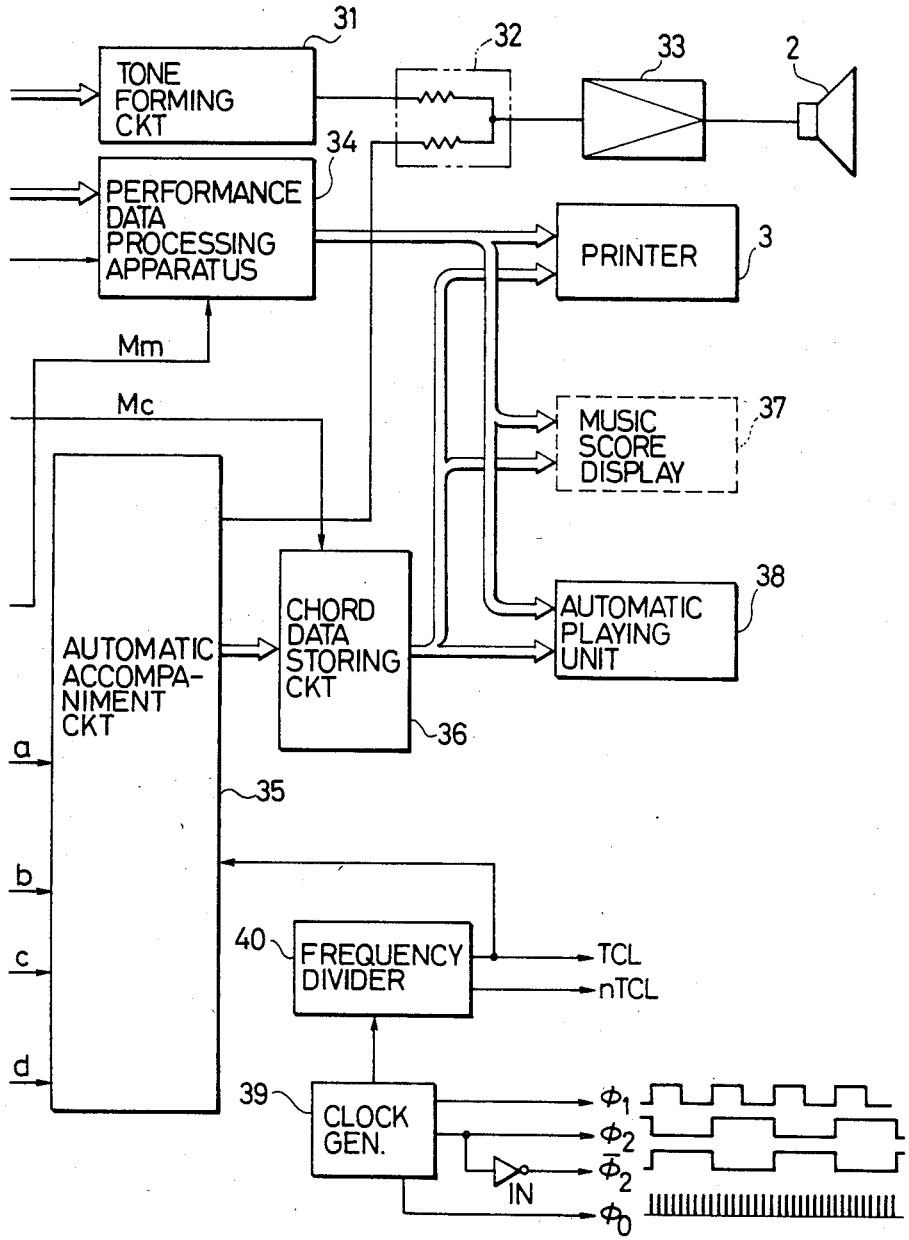

FIGS. 3A and 3B, in combination, are a block circuit diagram showing an overall outline of the circuit arrangement of the abovesaid electronic keyboard musical instrument equipped with a printer. In these Figures, what is shown in detail is only the switching signal processing circuit 30 intended for providing the state which enables the performance data to be stored by one touch operation of said easy printing operation switch 22 which is peculiar to this embodiment.

Numeral 31 represents a tone forming circuit which receives, as its input, key data KD generated by the internal circuit of the keyboard 1 in accordance with key operation, and forms tone signals with note pitch data and with a key depression/release data due to the presence or absence of the note pitch data. These tone signals are inputted, via a mixing circuit 32, to an amplifier 33, and are converted to an audible sound by the loudspeaker 2.

Numeral 34 represents a performace data processing apparatus embodying the present invention. It is supplied, as its input, with key data KD from the keyboard 1 and, stores the note pitch data and the note duration data of said inputs and also the rest duration data corresponding to the duration of absence of the key data KD, thereby constituting performance data consisting of a sequential train of notes and rests which constitutes a music score. The details of the operation of this processing apparatus will be described later.

Numeral 35 represents an automatic accompaniment playing circuit. This is of a conventional structure and is supplied, as its inputs, with the signals from, for example, respective outputs of the switching signal processing circuit 30, and, although not specifically shown, with the signals from, for example, the left-fingers keyboard section 1L, the ABC volume 9, the arpeggio volume 13, the rhythm volume 14, the tempo volume 15 and the rhythm selection switch group 17, to automatically produce a chord note signal with a selected rhythm to deliver it to the amplifier 33 via the mixing circuit 32, and these signals along with said music signal (mainly melody note), are converted, together with the tone signals from the tone forming circuit, into audible sounds by the loudspeaker 2.

Numeral 36 represents a chord data storing circuit which is supplied, as its input, with chord data indicative of chord names from said automatic accompanimen playing circuit 35, and stores these data one after another in succession.

Figure 1A:
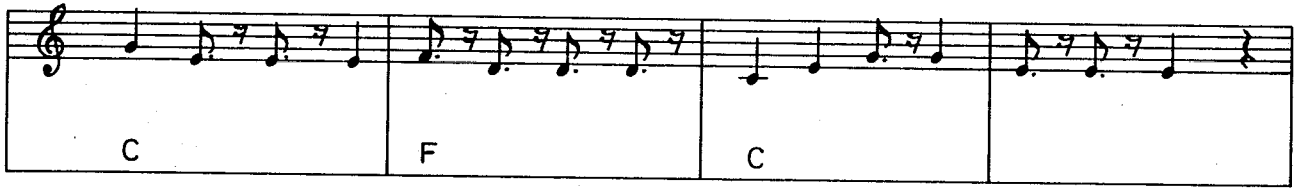
FIGS. 1A and 1B are illustrations showing an example of music score to explain the object and the effect of the present invention.
Figure 1B:
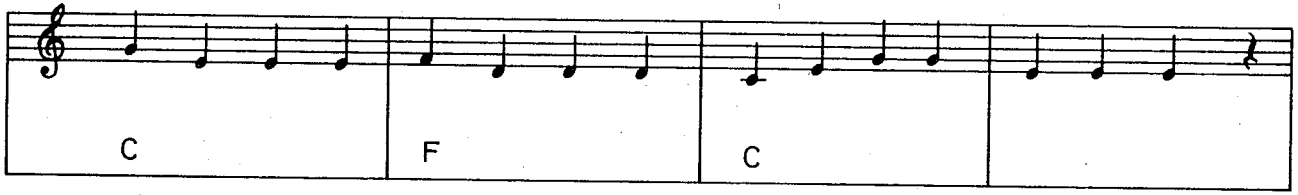

The printer 3 reads out, from said performance data processing apparatus 34, performance data comprised of the note data and the rest data, and reads out chord data from the chord data storing circuit 36, and prints out the result of performance on a sheet of paper in the form of a music score and a chord name such as C or F corresponding thereto as shown in FIG. 1B, to compose a music score.

Also, though not provided in the embodiment of FIG. 2, it is possible to provide a music score display unit 37 using a liquid crystal pattern or LEDs to display a performance data as a music score.

Numeral 38 represents an automatic playing unit. Upon actuation of the melody play switch 7c and the ABC play switch 8c shown in FIG. 2, this unit reads out successively note pitch data and note duration data from the performance data storing unit 34, and also reads out successively chord data from the chord data storing circuit 36, to thereby perform an automatic playing.

Numeral 39 represents a clock pulse generating circuit comprised of an oscillation circuit and a frequency dividing circuit. It outputs a reference pulse $\phi_0$ of a very high frequency, and also a clock pulse $\phi_1$ which has a frequency obtained by dividing the frequency of said reference pulse appropriately, and also a clock pulse $\phi_2$ which is one half of the frequency of this clock pulse $\phi_1$.

A frequency divider 40 further divides the frequency of the clock pulse $\phi_2$ supplied from said clock pulse generating circuit 39, and outputs a tempo clock TCL and a pulse nTCL for counting a note duration having a frequency (corresponding to the shortest note duration to be detected) which is n times greater than the cycle of said tempo clock TCL.

The tempo clock TCL is inputted to the automatic accompaniment playing circuit 35 to become a reference rhythm signal. The other clock pulses $\phi_0$–$\phi_2$, and the clock pulse $\phi_2$ which is an inverted clock pulse $\phi_2$ done by an inverter IN are used for the controlling of various actions of the performance data storing unit of the performance data processing apparatus 34.

The switching signal processing circuit 30 is comprised of a toggle type flip-flop circuit (hereinafter to be called "T-FF") 41 which inverts its output each time the easy playing performance switch 22 of the self-return type is actuated, a one shot multivibrator 42 which forms a pulse with the $\overline{Q}$ output of the flip-flop circuit 41, two set-reset type flip-flops (hereinafter to be called "R-S FF") 43, 44, and AND circuits 45~49 and OR circuits 50~54 each being equipped with an inverter for one of its input terminals.

An initial clear signal IC becomes high level "1" for a short time when the power switch 20 of FIG. 2 is turned on, and resets T-FF 41 and also R-S FFs 43, 44.

It should be understood that the melody memory switch 7a and the ABC memory switch 8a are locked to their actuated state when a push button is depressed to turn them on, and their locked state is released when the respective off switches 7b and 8b are turned on.

The single finger chord switch 11, the auto arpeggio switch 13S and the duet switch 10 are each of the "push-on and push-off" type switch.

In the past, in an electronic musical instrument of the abovesaid type, in order to have the instrument store performance data and print out a music score based on the stored performance data, it has been necessary, even when the performance is limited to only a melody playing, to do at least the following operations, i.e. first actuate the melody memory switch 7a, and then actuate either the standby switch 23 or the start/stop switch 24 of FIG. 2.

In case a chord accompaniment playing is to be performed also on such a conventional instrument, it has been required further to actuate the ABC memory switch 8*a*, and the single finger chord switch 11, respectively, and to turn off the auto arpeggio switch 13S and the duet switch 10, respectively.

In this embodiment also, by making such switching operations as described above, the melody memory switch 7*a* is turned on, causing the output of the OR circuit 52 to become "1", thus setting the R-S FF 44. As a result, the melody memory signal Mm which is a Q output of this R-S FF 44 becomes "1", and upon actuation of the ABC memory switch 8*a*, the output of the OR circuit 50 becomes "1", thereby setting the R-S FF 43, and its Q output chord memory signal Mc becomes "1".

Furthermore, the T-FF 41 is reset by a signal IC when the apparatus is connected to the power supply, and since its Q output easy print signal EP then is rendered to "0", the output of the AND circuit 47 becomes "1" upon actuation of the single finger chord switch 11, and the output signal "a" of the OR circuit 54 becomes "1".

Owing to the actuation of the synchronous start switch 16, the signal "b" becomes "1", and as the auto arpeggio switch 13S and the duet switch 10 are turned off, the respective output signals "c" and "d" of the AND circuits 48 and 49 become "0".

Due to such conditions as mentioned above, the storing of the melody performance and the chord performance becomes possible, so that by the actuation of the standby switch 23 of the printer 3, it will be understood that, by an actuation of the start/stop switch simultaneously with the starting of a key depression, the printer 3 will be immediately set to action and a music score is printed out.

However, according to this embodiment, the user does not have to follow such troublesome switching procedures as mentioned above, but instead it is only necessary for the user to turn on the easy printing operation switch 22 once. Whereupon, the output of the T-FF 41 is inverted, and its Q output easy print signal EP becomes "1", thereby setting the R-S FF 43 via the OR circuit 50, rendering the chord memory signal Mc to "1", which, in turn, sets the R-S FF 44 via the OR circuit 52 to render the melody memory signal Mm to "1". And, furthermore, the inverter-equipped inputs of the AND circuits 45 and 46 are rendered to "1", and concurrently inhibiting the inputs of the ABC memory off switch 8*b* and the melody memory off switch 7*b*.

Furthermore, the above actions render the output signal "a" of the OR circuit 54 to "1", and also render the inverter-equipped inputs of the AND circuits 48 and 49 to "1", respectively, so that their respective output signals "c" and "d" are maintained "0".

In this way, signals exactly the same as those in case the abovesaid respective switching operations are carried out are delivered to the performance data storing unit 34, the chord data storing circuit 36 and the automatic accompaniment playing circuit 35, so that not only the storing of the melody and chord playing are made feasible, but also, as will be discussed later, the standby switch 23 of the printer 3 also is rendered to the actuated state, so that, simultaneously with the starting of a key depression, the printer 3 is actuated and a music score is printed out.

As discussed above, a one-touch operation of the easy printing operation switch 22 brings about the standby state, so that the operation becomes very simplified.

It is needless to say, however, that, prior to starting a performance, there is the necessity to carry out the following items, i.e. to confirm whether or not a transposition is done by operating the transposition selection knob shown in FIG. 2; and if yes, to confirm which tonality is selected; to confirm the tone volume of the base chord by the ABC volume 9; to confirm the tempo of rhythm by the tempo volume 15; and to confirm the type of rhythm by the rhythm selection switch group 17, and so on.

Next, description will be made of the basic arrangement of the performance data processing apparatus 34 embodying the present invention by referring to FIG. 4.

This performance data processing apparatus is comprised of a pitch data temporarily storing means 55, a duration data generating means 60, a duration data temporarily storing means 65, a duration correcting means 70, and a pitch/duration data storing means 80.

And, this performance data processing apparatus causes the pitch data temporarily storing means 55 to store temporarily in succession the note pitch data (key code signals) of a number for one measure due to the key data KD generated by the keyboard 1.

On the other hand, the duration of each key data KD is detected by the duration data generating means 60 to generate duration data mating with the respective note pitch data, and they are caused to be stored in succession in the duration data temporarily storing means 65.

The duration correcting means 70 is one which eliminates such short rest as the 16th rest which comes after the note shown in FIG. 1A from among those duration data which have been stored temporarily in the duration data temporarily storing means 65, and corrects the duration data of the note so as to prolong, for an amount corresponding to such length of the eliminated rest, the forward note in such way as shown in FIG. 1B.

And, the pitch data temporarily stored in the pitch data temporarily storing means 55 and the duration data thus corrected by the duration correcting means 70 are caused to be stored in succession in the pitch/duration data storing means 80.

In case there are present both the pitch data and the duration data, they will provide a note data. In case tne pitch data is absent (means: all zero), and only the duration data is present, this will provide a rest data.

The duration data correcting means 70 in this embodiment is comprised of the below-mentioned parts.

(a) a judging unit 71 which inputs the two successive data $D_F$ and $D_R$ which have been stored in the pitch data temporarily storing means 55, and judges that the forward data $D_F$ (data indicative of the note or rest which locates ahead among successive two data) contains a pitch data and that the rearward data $D_R$ (data indicative of the note or rest which locates next among the two data) does not contain a pitch data (in short, a rest comes after a note);

(b) a comparator 73 which compares the duration data $L_R$ corresponding to the rearward data $D_R$ inputted into the judging circuit 71 from among those duration data stored in the duration data temporarily storing means 65 against the minimum duration data $L_m$ corresponding to the minimum rest (for example eighth rest) which has been preliminarily set by a minimum duration setter 72 and which is not eliminated even when there is a rest present at the end of a note, and to deliver an output when the former is shorter than the latter ($L_R < L_m$);

(c) an adder 74 for adding the duration data $L_F$ (data indicative of the time length of the note or rest which locates ahead among successive two duration data) and $L_R$ (data indicative of the time length of the note or rest which locates next among the two duration data) which have been stored in the duration data temporarily storing means 65 and respectively correspond to the forward data $D_F$ and the rearward data $D_R$, and for outputting the resulting signal;

(d) a selector 75 which, in case the outputs $d_1$ and $d_2$ of the judging unit 71 and the comparator 73 are both present (meaning: in case they are "1"), selects and delivers, in place of the forward note duration data $L_F$, the output of the adder 74 which is the added result of the duration data $L_F$ and $L_R$, respectively, without outputting the rearward rest duration data $L_R$, and in any instance other than this, outputs both said duration data $L_F$ and $L_R$ exactly just as they are; and (e) a shift register for correction 76 which stores the output data of the selector 75 so as to correspond to the respective stored data of the pitch data temporarily storing means 55.

Next, description will be made of a more concrete embodiment of the performance data processing apparatus by referring to FIGS. 5A and 5B to 8. In FIGS. 5A and 5B, the respective sections corresponding to those in FIG. 4 are each surrounded by a one-dot-chain line and assigned with like reference numerals and symbols.

The respective sections shown in FIGS. 5A and 5B are operated by the respective control signals from a control circuit 81, and by the melody memory signal Mm from the R-S FF 44, the respective clock pulses delivered from the clock generator 39 and from the frequency divider 40 shown in FIG. 3B.

Now, description will be made first of the function of the control circuit 81 having the arrangement shown in FIG. 7.

The standby switch 23 which has been shown also in FIG. 2 is a push-on type switch, whereas the start/stop switch 24 is a push-on/push-off type switch.

When the standby switch 23 is turned on while the melody memory signal Mm is "1", the output of an AND circuit 811 becomes "1", and the output of an OR circuit 812 also becomes "1". Accordingly, the print start signal PST which is an output of an OR circuit 813 is rendered to "1", and concurrently therewith an R-S FF 814 is set thereby and its Q output becomes "1" and this FF is rendered to its standby state.

Also when the easy printing operation switch 22 of FIG. 3A is turned on and when thereby the easy print signal EP is rendered to "1", the output of the OR circuit 812 will become "1". Accordingly, this circuit also assumes its standby state in the same way as in the instance discussed just above.

When, under such state as mentioned just above, a key is depressed, there appears a note pitch data in the key data KD. Therefore, the key-on signal KON which represents the output of an OR circuit 82 which takes an OR of each bit of the key data KD shown in FIG. 5A becomes "1". Accordingly, the output of an AND circuit 815 of FIG. 7 becomes "1".

Thus, the output of an OR circuit 816 also becomes "1", and sets an R-S FF 817. Therefore, the behavior signal RUN which is a Q output of this R-S FF becomes "1", so that the performance data processing apparatus as a whole shown in FIGS. 5A and 5B starts its actions. Concurrently therewith, a measure counter 818 is enabled, causing the counting of the tempo clock pulses TCL to be started. And, the R-S FF 814 is reset by an output of the AND circuit 815.

The measure counter 818, when it counts the tempo clock pulses TCL of a number (e.g. 192) corresponding to the length of one measure, renders the count-over signal $J_1$ to "1", and concurrently resets itself, and again starts the counting of tempo clock pulses TCL from the beginning "0".

When the count-over signal $J_1$ becomes "1", the output of an OR circuit 819 becomes "1", and an R-S FF 821 is set with a delay corresponding to one cycle length of the reference pulse $\phi_0$ by a delay circuit 820, and renders the write-in signal $J_2$ which is a Q output of said FF to "1".

Now, when the start/stop switch 24 is turned on when the melody memory signal Mm is "1", the output of an AND circuit 822 turns from "0" to "1". Accordingly, a one-shot multivibrator 823 outputs a pulse, and via the OR circuit 813, it renders the print start signal PST to "1", and concurrently sets the R-S FF 817 via the OR gate 816. Accordingly, this renders the action signal RUN to "1" and enables the measure counter 818. As a result, the operations of the performance data processing apparatus 34 and of the printer 3 are commenced immediately without awaiting the start of a key depressing action.

In such instance as mentioned just above, whole rests will be printed out until the key depression is started.

As discussed above, either by again turning the easy printing operation switch 22 on to render the easy print signal EP to "0", or by again depressing the start/stop switch 24 to turn it off either from the state that the easy print signal EP is "1" or from the state that the start/stop switch 24 has been turned on, a decay differentiating circuit 224 or 225, depending on the case, outputs a decay pulse, causing the output of an OR circuit 826 having inverters on its two input terminals to become "1" for a very short length of time, resetting the R-S FF 817, rendering the action signal RUN to "0", and delivers this "0" output as a termination signal ST.

When this termination signal ST becomes "1", this will set the R-S FF 821 with a delay corresponding to one cycle length of the reference pulse $\phi_0$ via the OR circuit 819 and the delay circuit 820, and renders the write-in signal $J_2$ to "1".

Description will hereunder be made of the arrangements and the operations of the respective sections of FIGS. 5A and 5B.

A pitch data temporarily storing means 55 is provided, in addition to having a principal section comprising a selector 550, a latch circuit 551, and a shift register 552 for note pitch, with a bar line data generating circuit 553, and finish line data generating circuit 554, a control signal generating inverter 555, a one-shot multivibrator 556, an OR circuit 557, and a delay circuit 558.

The shift register 552 for pitch data has a capacity enough for storing a note pitch data (including the case of zero for the rest also) for a single measure. For example, if the minimum note duration which is to be stored is either a sixteenth note or a sixteenth rest, this register has a shifting capacity of 16 bits.

The bar line data generating circuit 553 is intended to generate a bar line data which is to be entered at the end of each measure. The finish line data generating circuit 554, on the other hand, generates a finish line data which is comprised of a thin line and a thick line which are to be entered at the finish of a music composition or phrase.

The duration data generating circuit 60 is comprised of an event detecting circuit 600, an OR circuit 601, a 4-input OR circuit 602, a duration counter 603, an AND circuit 604, a delay circuit 605, a comparator circuit 606, and a latch circuit 608.

The duration temporarily storing means 65 is formed with a shift register 650 for the duration data having a same capacity as that of the shift register 552 for the pitch data, and a delay circuit 651 outputting a shift pulse of said shift register.

The duration correcting means 70 is provided with a shift register 76 for correction having a same capacity as that of the shift register 650 for the duration data. A corrected duration data is temporarily stored in this duration correcting means 70. The details of this means 70 will be described later by referring to FIG. 8.

The pitch/duration data storing means 80 is comprised of: a data storing RAM (Random Access Memory) 800 and the circuits for change-over of its input data, consisting of gating circuits 801 and 802, and an OR circuit 803; the circuits for inputting address data, consisting of a write-in address counter 804, a read-out address counter 805 and a selector 806; and a gating circuit 807 and an AND gate 808 for controlling the write-in operations.

Numeral 83 represents an OR circuit outputting a gate signal for controlling the gating circuit 807. Numeral 84 represents a bar line detecting circuit, outputting a signal $J_3$ when the output data from the shift register 552 for note pitch contains a bar line data.

Numeral 85 represents a shift pulse changeover circuit for switching the shift pulse given at the time of reading out the data of both the shift register 552 for the pitch data and the shift register 76 for correction, by the presence or absence of an output data. This shift pulse changeover circuit 85 is comprised of: a NOR circuit 850 which takes a NOR logic of each bit of the output data delivered from the shift register 552 for the pitch data; a NOR circuit 851 for taking a NOR of each bit of the output data delivered from the shift register 76 for correction; an AND circuit 852 for taking an AND of the outputs of said NOR circuits 850 and 851 and the write-in signal $J_2$; AND circuits 853 and 854 and an OR circuit 855 for switching the shift pulse of said shift register 552 for the pitch data over to either the clock pulse $\phi_0$ or the clock pulse $\phi_1$; and similar AND circuits 856 and 857 and an OR circuit 858 for switching the shift pulse of said shift register 76 for correction to either the clock pulse $\phi_0$ or to the clock pulse $\phi_1$.

Figure 6:
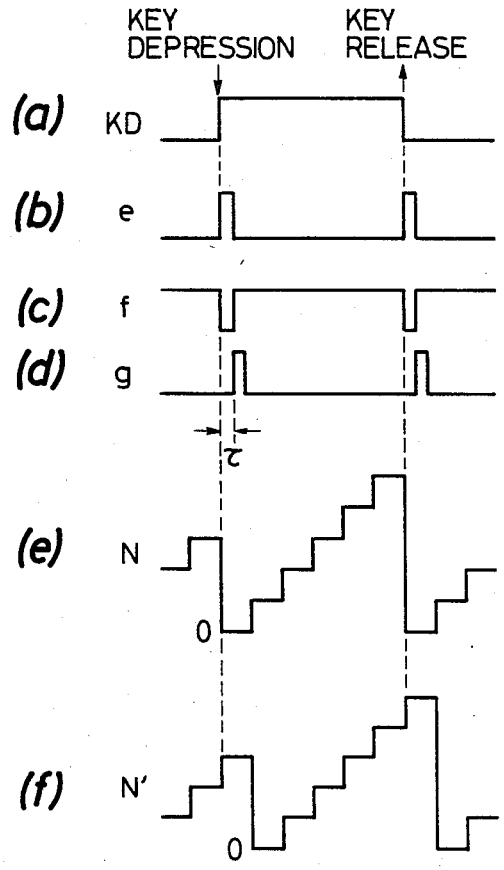
FIG. 6 is a signal waveshape chart for use in the explanation of the operation of the circuit of FIG. 5A.

The event detecting circuit 600 is one for generating an event pulse "e" as shown in FIG. 6(*b*) upon a key depression and a key release, in accordance with such a change in a key data KD as shown in FIG. 6(*a*). This circuit 600 is comprised of, for example, a build-up differentiating circuit and a decay differentiating circuit, an inverter for inverting the decay differentiating pulse, and an OR circuit (including a waveshape regulation) which takes an OR with a build-up differentiating pulse.

When an event pulse "e" is delivered out from this event detecting circuit 600, it resets the note duration counter 603 via the OR circuits 601 and 602. Concurrently therewith, the event pulse which has passed through the OR circuit 601 is inputted also to the note pitch data temporarily storing means 55, and it is inverted as shown in FIG. 6(*c*) by the inverter 555. With the build-up of this inverting pulse "f", the one-shot multivibrator 556 is triggered, and a somewhat delayed pulse "g" is inputted to a selection terminal SA of the selector 550 as shown in FIG. 6(*d*).

Whereby, the selector 550 selects the pitch data which has then been inputted to the terminal A thereof, and outputs same to the latching circuit 551. The latching circuit 551 latches the data outputted from the selector 550, as it receives an output pulse of the OR circuit 557 which takes an OR of the input pulses delivered to the respective selection terminals SA, SB and SC of the selector 550.

The output pulse of the OR circuit 557 is delayed for a half cycle period of the reference pulse $\phi_0$ by the delay circuit 558, and is passed through the OR circuit 855 and is inputted to a clock terminal of the shift register 552 for note pitch. Whereby, the data latched by the latching circuit 551 is stored temporarily in the shift register 552 for the pitch data.

Accordingly, since there is a note pitch data present in the key data KD in the period immediately after a key depression, the latching circuit latches this note pitch data, and causes the shift register 552 for the pitch data to store same temporarily. Immediately after the key release, there is no note pitch data present, so that a zero data is latched and this is stored temporarily in the shift register 552 for the pitch data. When this pitch data is zero, it becomes a data indicative of a rest.

On the other hand, the duration counter 603 is operated in such way that, when, after being reset by the generated event pulse "e", the operation signal RUN from the control circuit 81 is in its "1" level, it counts the duration counting pulse nTCL (a pulse having a period corresponding to the minimum length duration which is to be stored, for example, the 16th note or 16th rest, or a pulse of a period somewhat shorter than that) which is inputted to a clock terminal via the AND circuit 604.

The count data N of this duration counter 603 serves as an A input of the comparator 606, and concurrently is inputted to the latching circuit 608 with a delay of a length of one whole cycle of the duration counting pulse nTCL, and also serves as a B input of the comparator 606.

Accordingly, the count data N of the duration counter 603 becomes augmented as shown in FIG. 6(*e*) in accordance with the interval with which the event pulses "e" are generated, i.e. in accordance with the key depression time or the key release time, and the counter is reset by the event pulse "e" and the count data becomes ——0——. The delay data N′ by the delay circuit 605 will become a data representing a count data N with a delay of one count as shown in FIG. 6(*f*).

Accordingly, from the time that the duration counter 603 has freshly started counting the pulse nTCL till immediately before a next event pulse "e" is generated, the relationship between N and N′ remains to be $N>N'$, the relationship between the A input and B input of the comparator 606 is $A>B$, and since its output has become "0" level, the latching circuit 608 does not latch the input data N′.

When a next event pulse "e" is generated and thus the note duration counter 603 is reset, the count data N becomes —0—, and the delay data N′ by the delay circuit 605 becomes equal to the count data N which is at the stage immediately prior to being reset, and therefore, only for the interval, the relationship between the A input and the B input of the comparator 606 becomes $A<B$, and the output of the comparator 606 becomes "1".

Whereby, the latching circuit 608 latches the then delay data N', and outputs same as a duration data to the shift register 650 for the duration data.

When the output of the comparator 606 becomes "1", this output is delayed for one half cycle of the reference pulse $\phi_0$ by the delay circuit 651 and is inputted to a clock terminal of the shift register 650 for duration data, and causes this shift register 650 for duration data to temporarily store the duration data latched by the latching circuit 608.

The duration data due to the count data during the key depression indicates the length of the note, whereas the duration data due to the count data during the key release is indicative of the length of the rest.

For example, when the duration data is —1—, it indicates either a sixteenth note or rest, and when it is "2", it indicates either an eighth note or eighth rest, and when it is "4", it indicates either a fourth note or fourth rest, and when it is "8", this will represent a half note or half rest, and when it is "16", it will represent a whole note or whole rest.

With such an arrangement as described above, it will lead to the operation that a key depression time or a key release time shorter than the 16th note or 16th rest is disregarded. However, by setting the cycle of the note duration counting pulse nTCL sufficiently shorter than the minimum length duration, and by amending the duration data latched by the latching circuit 608 through the disposition of the fractions so as to become a minimum length note duration unit for being stored, it becomes possible to obtain a more precise duration data.

In this way, for each key depression and key release, the pitch data and the duration data are paired with each other, and they are temporarily stored successively by the shift register 552 for the pitch data and also the shift register 650 for the duration data, and the precedingly stored data are shifted toward the right side in the Figure.

Figure 7:
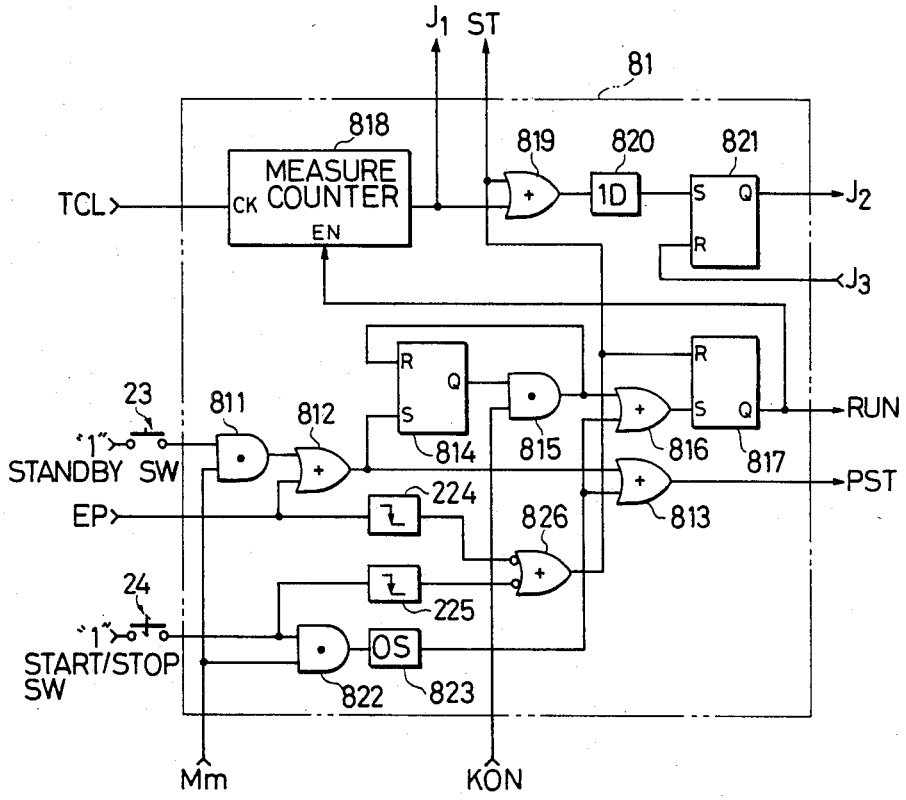
FIG. 7 is a block circuit diagram showing an example of the control circuit arrangement in FIG. 5A.

And, when a measure counter 818 shown in FIG. 7 has counted tempo clock pulses TCL enough for one measure, and a count over signal $J_1$ is outputted from the control circuit 81, the duration counter 603 is reset via the OR circuits 601 and 602, and concurrently therewith the selection terminal SB of the selector 550 is rendered to "1", and the bar line data delivered from the bar line data generating circuit 553 is selected and latched in the latching circuit 551, causing the shift register 552 for the pitch data to store it.

Accordingly, when either a key depression state or a key release state continues till after the arrival of the end of one measure, the note or rest therefor is divided so as to be positioned before and after the bar line indicative of a measure. It should be understood that in such instance as described above, if a note is divided, arrangement may be made so as to place a "tie" additionally.

When the easy print signal EP shifts from "1" to "0", or when the start/stop switch 24 is turned from "on" to "off", a finish signal ST is outputted from the control circuit 81 as stated earlier.

Whereby, the duration counter 603 is reset through the OR circuit 602, and concurrently therewith the selection terminal SC of the selector 550 is rendered to "1", thus selecting the finish line data delivered from the finish line data generating circuit 554 to be latched by the latching circuit 551, and this is stored by the shift register 552 for the pitch data.

Now, when a countover signal $J_1$ of the measure counter 818 is outputted from the control circuit 81, and when an abovesaid finish signal ST is generated, the write-in signal $J_2$ is rendered to "1" with a short delay.

Whereby, there is carried out, during a very short period of time, a data transmitting operation to successively read out the data stored temporarily in the shift register 552 for the pitch data (said data including, in addition to note pitch data, the rest data due to the absence of a note pitch data, as well as bar line data and finish line data), and also the duration data temporarily stored in the shift register 650 for the duration data and stored in the shift register 76 for correction after being corrected by the duration correcting means 70, and to successively write in the RAM 800 of the pitch/duration data storing means 80.

At such time, the shift register 552 for pitch data and the shift register 76 for correction each has a capacity sufficient for storing the data of a maximum number of notes of one measure (in this embodiment, they are 16 in number), and accordingly it is very seldom that these registers are filled entirely with data, and the shift bits on the right side in FIG. 5B are empty. Also, the shift register 76 for correction may contain a portion wherein duration data is absent as a result of correction.

In order to increase the read-out speed of such portion as mentioned above, and to reduce the transmission time of the data, there is provided the shift pulse changeover circuit 85.

That is, so long as the respective data which are outputted from the right-side ends of both the shift register 552 for pitch data and of the shift register 76 for correction remain —0—, respectively, the outputs of the NOR circuits 850 and 851 will invariably become "1". When, at such time, the write-in signal $J_2$ has been rendered to "1", the output of the AND circuit 852 also will become "1".

The output of this AND circuit 852 is inputted, as it is, to the AND circuits 853 and 856, and is inverted and inputted to the AND circuits 854 and 857. Accordingly, the AND circuits 853 and 856 let a high frequency reference pulse $\phi_0$ pass therethrough. Thus, this reference pulse $\phi_0$ passes through the OR circuit 855 to be inputted, as a shift pulse, to the clock terminal of the shift register 552 for pitch data and also passes through the OR circuit 858 to be inputted, as a shift pulse, to the clock terminal of the shift register 76 for correction, so that the data of the respective shift registers 552 and 76 are shifted to the right side with a high speed.

And, when data is outputted from at least one of the shift register 552 for pitch data and the shift register 76 for correction, the output of at least one of the NOR circuits 850 and 851 becomes "0", so that the output of the AND circuit 852 becomes "0".

Whereby, the AND circuits 853 and 856 no longer will pass the reference pulse $\phi_0$ therethrough, but the AND circuits 854 and 857 will pass therethrough the clock pulse $\phi_1$ which has a frequency lower than the reference pulse $\phi_0$, to be inputted, as a shift pulse, to the clock terminals CK of the shift registers 552 and 76, via the OR circuits 855 and 858, respectively.

Accordingly, the stored data of the shift register 552 for pitch data and of the shift register 76 for correction are shifted toward the right side, respectively, with a normal read-out speed, and they are read out successively.

It should be understood here that the portion of the shift register 76 for correction where the duration data for the rest is absent due to the correction of the note duration, and also its corresponding pitch data are both —0— for a rest, so that such portions are shifted quickly to patch up the vacancies.

Next, in the pitch/duration data storing means 80, the write-in signal $J_2$ has been rendered to "1", so that the RAM 800 is plunged to the write-in state, and the selector 806 selects the address data supplied from the write-in address counter 804, and designates the write-in address of the RAM 800.

The gating circuits 801 and 802 are opened alternately by a clock pulse $\phi_2$ and its inverted clock pulse $\phi_2$, so that the output data delivered from the shift register 552 for pitch data and the corresponding output data delivered from the shift register 76 for correction are outputted alternately to the OR circuit 803, and they are written successively in the RAM 800.

However, during the quick shifting done when the melody memory signal Mm is "0" or when the output of the abovesaid AND circuit 852 is "1", the output of the OR circuit 83 is in its "1" state. Accordingly, the gating circuit 807 having an inverter at its control terminal is closed, keeping out any clock pulse $\phi_1$ from inputting into the write-in address counter 804 so as not to change the write-in address of the RAM 800 to thereby eliminate any wasteful data-absent write-in operation from taking place.

When the bar line detecting circuit 84 has detected a bar line data, it renders the signal $J_3$ to "1", so that the R-S FF 821 (FIG. 7) of the control circuit is reset, thereby rendering the write-in signal $J_2$ to become "0". Accordingly, the read-out of data from the shift register 552 for pitch data and from the shift register 76 for correction is terminated. Concurrently, the RAM 800 is rendered to its read-out state, and the selector 806 selects the address data supplied from the read-out address counter 805, thereby renewing the address at each input of a read-out pulse CK supplied from the printer circuit which will be described later, and thus such data as the pitch data and the duration data which have been stored are read out successively.

At such part of operation, the action of temporarily storing the pitch data and so forth as well as the duration data of the next measure has begun already.

Next, description will be made of a concrete embodiment of the note duration correcting means 70 by giving reference to FIG. 8.

Figure 4:
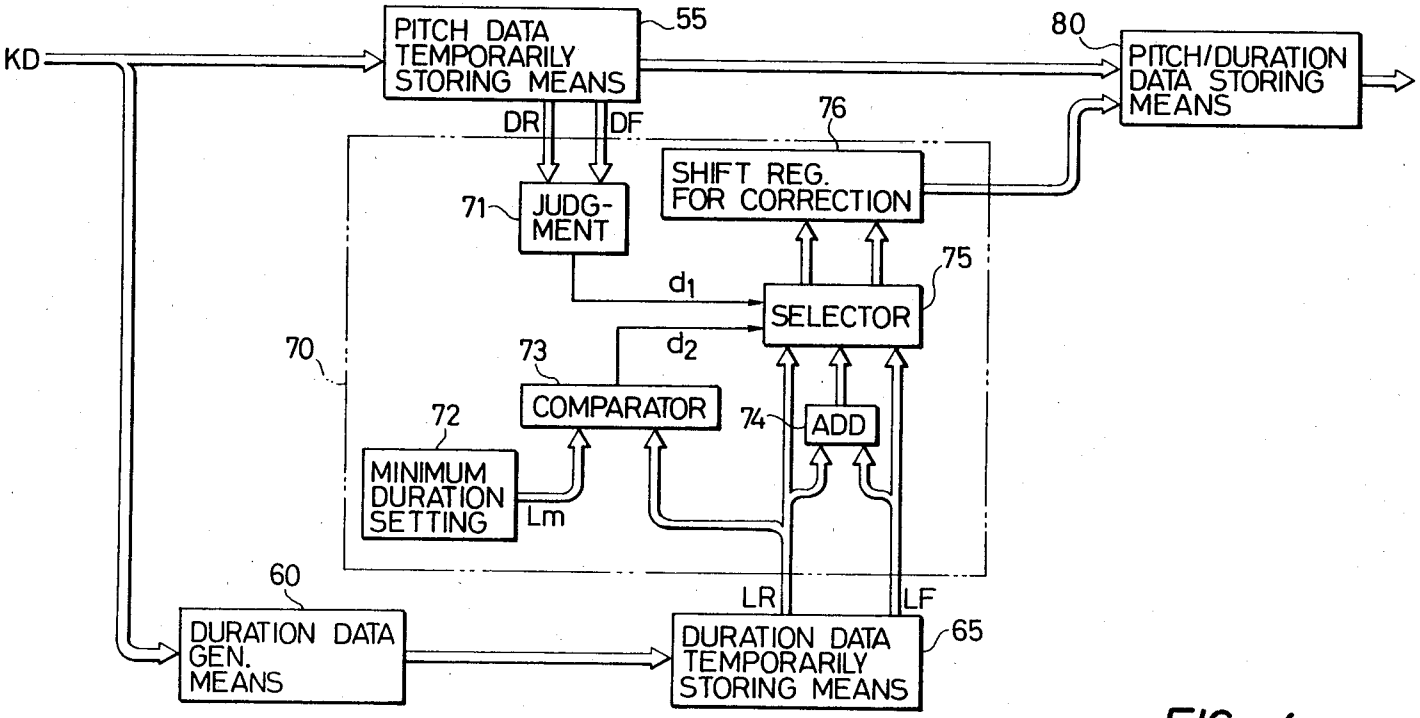
FIG. 4 is a block diagram showing the basic arrangement of the performance data processing apparatus in FIG. 3B.
Figure 5A:
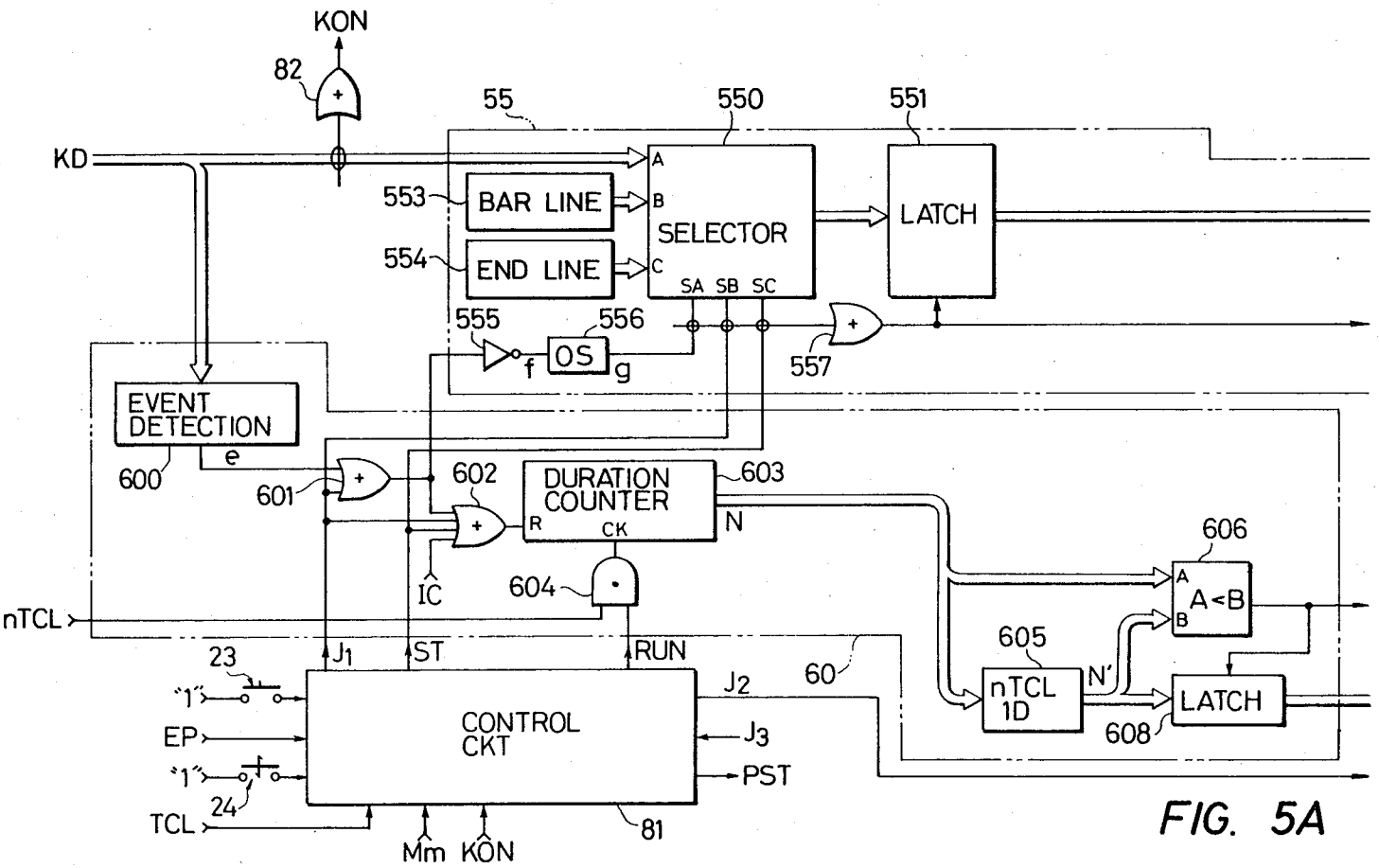
FIGS. 5A and 5B, in combination, are a block circuit diagram showing a concrete example of said basic arrangement of FIG. 4.
Figure 5B:
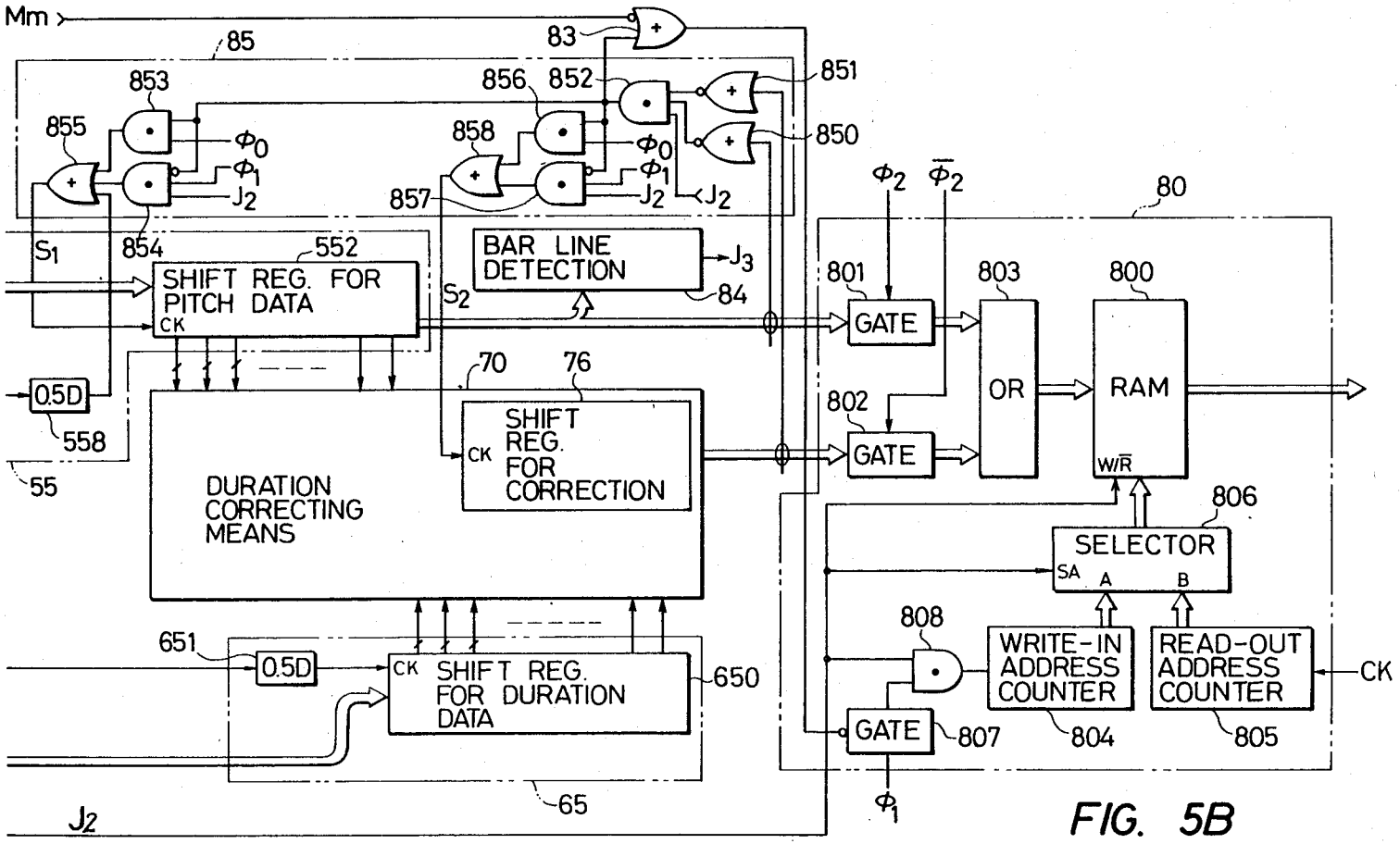
Figure 8:
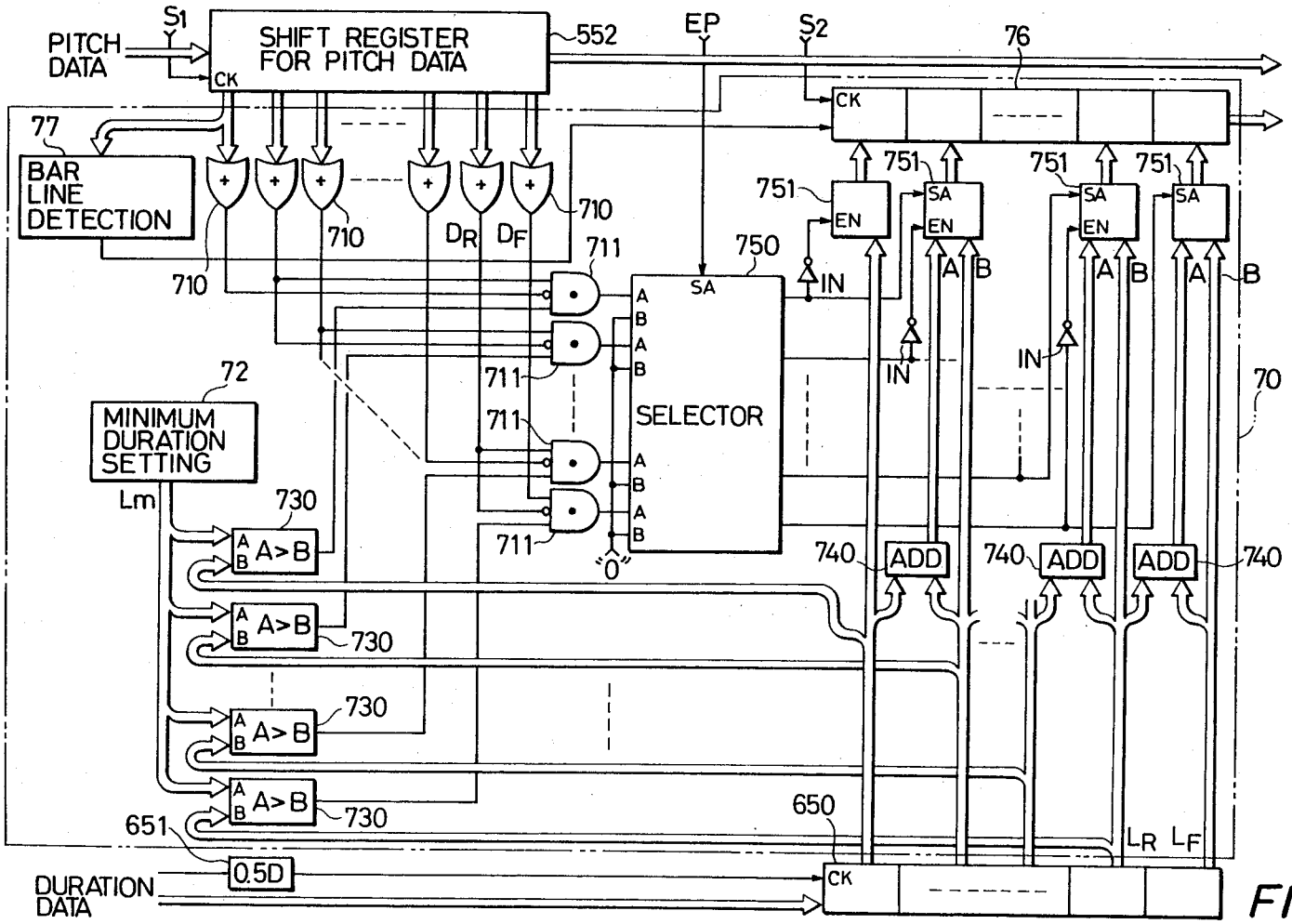
FIG. 8 is a block circuit diagram showing an example of arrangement of the note duration correcting means in FIG. 5B.

The section of the arrangement of FIG. 8 which corresponds to the judging unit 71 of FIG. 4 is comprised of a plurality of OR circuits generally indicated 710 (which, in this example, are 16 in number) and which take the OR of the respective whole bits of the data stored at the respective shifting positions of the shift register 552 for note pitch; and fifteen 3-input AND circuits generally indicated at 711 each using, as its first input, the output of the OR circuit 710 which takes the OR of the whole bits of the forward data $D_F$ (located on the right-hand side shift position in FIG. 8) among those data located at the two consecutive shift positions and stored in the shift register 552 for pitch data, and further using, as the second input, the inverted output of the OR circuit 710 which takes the OR of the whole bits of the rearward data $D_R$, and also using, as the third input, the output of comparators generally indicated at 730 which compare the duration data $L_R$ located at the shift positions of the shift register 650 for duration and corresponding to said rearward data $D_R$.

The respective comparators 730 use, as their B inputs, the note duration data stored at the respective shift positions of the shift register 650 for duration data excepting the forwardmost shift position (located at the right end in FIG. 8), and compare them with their A inputs which are data Lm corresponding to the eighth note duration set by the minumum length note duration setting means 72, and when A>B, i.e. when the note duration data is less than the eighth duration, they output "1".

The respective OR circuits 710 operate in such a way that, because of the fact that, when there is a pitch data in the inputted data, this means that there is "1" in at least any one of the bits, their outputs are "1", and that when pitch data is absent (when it is a rest data), the whole bits are "0", so that their outputs are accordingly "0".

Accordingly, the respective AND circuits 711 deliver their outputs "1" only when, among those data located at two consecutive shift positions stored in the shift register 552 for pitch data, there is a pitch data present in the forward data and there is no pitch data in the rearward data, and further when the duration data corresponding to said rearward data is less than the eighth note duration (meaning: at the time of 16th note duration). The outputs of these respective AND circuits 711 will serve as the A input of selector 750.

This selector 750 is provided with fifteen (15) pairs of A-input terminals and B-input terminals, and with output terminals corresponding to these respective pairs of input terminals, and a selection terminal SA. "0" is inputted to the respective B-input terminals. The selection terminal SA is inputted with an easy print signal EP. When this easy print signal EP is "1", the selector 750 selects those outputs of the respective AND circuits 711 which serve as the A-inputs thereof to deliver them out, and when the signal EP is "0", it selects "0" which are the B-inputs, and outputs this selected "0".

Fifteen (15) adders generally indicated at 740 which correspond to the adder 74 of FIG. 4 respectively add up those duration data stored in the consecutive two shift positions of the shift register 650 for duration data, and output them.

The section corresponding to the selection unit 75 of FIG. 4 is comprised of said selector 750 and sixteen (16) selectors 751 which are controlled of their selecting actions by the respective outputs of the selector 750.

And, the respective selection outputs of the sixteen (16) selectors 751 are stored at the respective shift positions of the shift register 76 for correction. Only that selector 751 which is assigned to store the output data at the extreme left end shift position in FIG. 8 inputs the data located at the extreme left end position of the shift register 650 for note duration. The remaining selectors 751 use, as their B-inputs, the duration data located at the corresponding shift positions of the shift register 650 for duration data, and use, as their A-inputs, the outputs of the adders 740 which add up the next duration data following them.

And, the respective output signals of the selector 750 are inputted to the selection terminals SA of their corresponding selectors 751, i.e. located at the right-hand side in FIG. 8 (intended for the forward note duration data), and after being inverted as they pass through inverters IN, they are inputted to the enable terminals EN of those selectors 751 which are located on the left-hand side in FIG. 8 (intended for the rearward rest duration data).

Accordingly, the particular selector 751 intended for the forward data corresponding to that bit of the output of the selector 751 which is rendered to "1" selects the note duration data supplied from the adder 740 and outputs the selected one, but the selector 751 intended for the rearward note duration data is not enabled, so that it does not output data.

The selector 751 for the forward note duration data corresponding to such bit that the output of the selector 750 is rendered to "0" outputs the duration data exactly as it is supplied from the shift register 650 for note duration, whereas the selector 751 for the rearward note duration data is enabled, so that, depending on whether the input of the selection terminal SA is "0" or "1", it selects either the duration data supplied from the shift register 650 for duration data or the output data of the adder 740, and outputs the selected one.

Such duration correction operation is carried out for each shifting of the data of the shift register 552 for pitch data and of the shift register 650 for duration data. However, the taking-in of the output data of the respective selectors 751 into the shift register 76 for correction takes place when detection is made by the bar line detector 77 that the bar line data has entered into the shift register 552 for pitch data.

Figure 9:
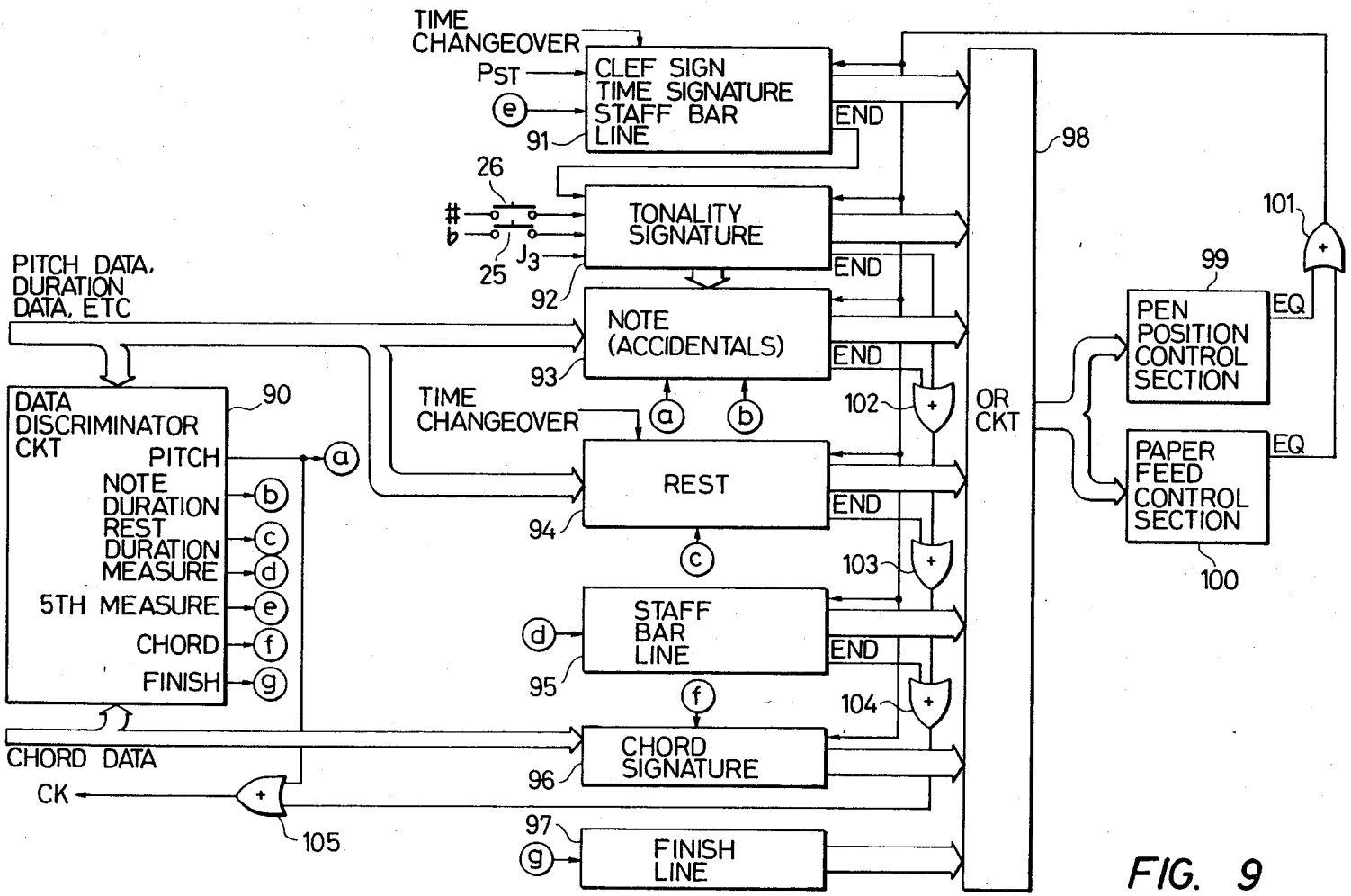
FIG. 9 is a block circuit diagram showing an example of arrangement of a printer cotrolling unit in FIG. 3B.

Finally, description will be made of the controlling means for the printer 3 by referring to FIG. 9.

This printer controlling means is comprised of: a data discriminator circuit 90; an initial measure ROM (Read Only Memory) 91, a tonality signature ROM 92, a note ROM 93, a rest ROM 94, a staff/bar line ROM 95, a chord signature ROM 96, a finish line ROM 97; OR circuits 98 for taking the ORs of the data read out from these respective ROMs; a pen position control section 99 for controlling the position of the printing pen to be in a direction perpendicular to the direction of the feed of the paper sheet; a paper feed controlling section 100 for controlling the position of the paper sheet which is fed; and OR circuits 101~105.

This printer controlling means is operative so that when a print start signal PST is inputted into the initial measure ROM 91, it reads out data stored in this ROM 91 necessary for printing the staff, the bar line and the clef (G clef, F clef, etc.) and the time signature (4/4, $\frac{3}{4}$, etc.) which are selected by a time changeover signal all for the initial measure, and forwards them to the pen position controlling section 99 and to the paper feed controlling section 100 via the OR circuit 98, and controls both the paper sheet intended for printing a music score and also the printing pen to be in a direction crossing each other at right angle, and thus prints out the staff, the bar line, the clef and the time signature for the initial measure.

During this part of operation, each time the pen position controlling section 99 and/or the paper feed controlling section 100 carry out or carries out the controlling of one pitch movement of either the pen or the paper sheet, the output of the OR circuit 101 becomes "1", and thus there is performed a reading out of the data from the initial measure ROM 91.

And, upon termination of the read-out of data from the initial measure ROM 91, there is read out data from the tonality signature ROM 92 assigned for printing out the tonality inscription upon generation of an end signal END from the ROM 91. This tonality signature ROM 92 stores the tonality signature data of all printable tonalities. However, it outputs a tonality signature data due to either the flat (♭) or the sharp (♯) of a number corresponding to the turn-on times of the flat-inputting switch 25 or the sharp-inputting switch 26 shown in FIG. 2 also. In case there has occurred no turning-on of the switch 25 or 26, the tonality signature ROM 92 does not deliver an output, so that the tonality at such time is "C".

Upon termination of read-out of the data from this tonality signature ROM 92, this ROM will deliver out an end signal END after the data for the first one measure is transmitted to the RAM 800 of FIG. 5B, and when the signal $J_3$ from the bar line detecting circuit 84 has become "1".

This end signal renders the output of the OR circuit 105 to "1" via the OR circuits 102~104, and it is inputted, as a read-out pulse CK, to the readout address counter 805 in the pitch/duration data storing means 80 of FIG. 5B and to the readout address counter (not shown) of the chord data storing circuit 36 of FIG. 3B.

Whereby, there are read out such data as pitch/duration data from RAM 800 of FIG. 5B and chord data from the chord data storing circuit 36 of FIG. 3B to be inputted to the data discriminating circuit 90. Concurrently, those data such as pitch and duration are inputted as address data into the note ROM 93 and the rest ROM 94, whereas the chord data are inputted as address data into the chord signature ROM 96.

And, the data discriminating circuit 90 outputs a signal (a) when there is a pitch data present in the inputted data, a signal (b) when both pitch data and duration data are present, a signal (c) when only duration data is present, a signal (d) when bar line data is provided, a signal (e) when the fifth measure arrives, a signal (f) when chord data is provided, and a signal (g) when there is a finish line data, respectively, thereby controlling the read-out of the data of the respective ROMs 93~97, and reads out the stored data such as notes (including temporary inscriptions), rests, chord signatures, staff and bar line for the next measure, and a finish line, and transmit them via the OR circuit 98 to the pen position controlling section 99 and to the paper feed controlling section 100.

Whereby, there is performed a printing out based on the respective data, and thus a music score is formed.

It should be noted here that one row of staff is arranged to be comprised of four measures. Therefore, for the fifth measure, the signal (d) is inhibited while the signal (e) is outputted, and again the data from the ROM 91 for the initial measure and from the ROM 92 for tonality signature are read out, to thereby cause the printing out of not only the music score and the measure alone, but also of a clef, time signature, tonality signature and so forth.

When the note pitch data is discriminated by the data discriminating circuit 90 and a signal (a) is outputted, and each time an end signal END is generated as the reading-out of the data of the respective ROMs 92~96 ends, there is outputted a readout pulse CK from the OR circuit 105, and fresh data are read out in succession and they are inputted.

In this way, there is printed out a music score in accordance with the performance data and after being corrected of note durations as shown in FIG. 1B.

It should be noted here that it is possible also to attain, through program processing by the use of a micro-computer, the functions of the respective sections of not only the duration correcting means shown in FIG. 8, but also the functions of the respective sections of the performance data processing apparatus.

Also, in the above-mentioned embodiment, arrangement is made so that the pitch data and the duration data for one measure are stored temporarily and that correction of durations are carried out simultaneously at the end of the measure. However, arrangement may be made so that there is provided a delay means for delaying, for the length of one data, the note/rest data which are comprised of pitch data and duration data, so that, other than the beginning of the measure, check-up is carried out of a fresh data and of the forward data, and that in case the forward data is note data (with the presence of the pitch data) and the fresh data is comprised of rest data (the pitch data is missing), and in case the durations thereof are less than the predetermined duration (for example, eighth note duration), the duration data of the fresh data is rendered to zero, and this duration data is added to the note duration data of the forward data and is stored in the storing unit, to thereby carry out corrections of note durations successively.

In such instance, whether or not this represents the beginning of the measure is judged by whether or not the data is the first one appearing after the measure counter has made a count-over.

Furthermore, a similar effect can be obtained by arranging so that, in place of making a correction of note duration according to the present invention prior to the storing of performance data, such correction of note duration is done in such manner as has been described above with respect to the performance data that has been read out, when the performance data is read out from the storing unit to print out a music score, or is displayed on a display unit, or is played automatically.

And, according to a specific embodiment, it is possible for the player of an instrument to select at will whether or not the any correction of note duration is to be made depending on the composition or the contents of the performance, or by such factors as whether or not a precise key touch is required. Thus, the scope of utility is expanded.

Especially, in case a music score is to be printed out, arrangement may be made so that, as in the case of the above-described embodiment, the printer also is rendered to its standby state by the one-touch operation of the easy-playing operation switch, whereby a further improvement of the operability is materialized.

What is claimed is:

1. A performance data processing apparatus, comprising:

means for forming performance data consisting of a sequential train of note data each comprised of a pair of a note pitch datum indicative of a note pitch and a note duration datum indicative of a note duration, and of rest data each having no pitch datum and comprised of only a rest duration datum indicative of a rest duration, said sequential train of note data and rest data forming a progression of a piece of music;

means for judging whether or not a rest datum immediately following a note datum among said performance data has a duration shorter than a predetermined duration;

means for integrating, when a result of said judgement is YES, a combination of said note datum and said rest datum into a single integrated note datum having a note pitch of said note datum and having a note duration equal to a sum of the note duration of said note datum and the rest duration of said rest datum; and means for producing revised performance data comprising a sequential train of note data and rest data which have not been integrated and said integrated note data.

2. A performance data processing apparatus according to claim 1, in which:

said means for integrating has means to form an integrated duration by adding two durations of every adjacent couple of said note data and/or rest data among said performance data, and selects out, only when the judgment by said judging means is YES, the integrated duration and combines into a pair with the note pitch of said note datum followed by said rest datum.

3. A performance data processing apparatus according to claim 2, in which:

the integrating means further has storing means to store the adjacent note data and/or rest data among the performance data, and said means to form an integrated duration adds the adjacent durations stored in said storing means.

4. A performance data processing apparatus according to claim 1, further comprising:

memory means to store the revised performance data comprised of a sequential train of said note data and rest data which have not been integrated and said integrated note data.

5. A performance data processing apparatus according to claim 4, further comprising:

printer means to print out a music score based on said revised performance data stored in said memory means.

6. A performance data processing apparatus according to claim 4, further comprising:

display means to display a music score based on said revised performance data stored in said memory means.

7. A performance data processing apparatus according to claim 1, in which:

said means for forming performance data comprises:

a keyboard;

a tempo clock generator which generates a tempo clock signal having a period of time predetermined in correspondence with a minimum note duration to be used on this apparatus; and means for forming note duration data indicative of a time interval between a depression and a release of a key of said keyboard, based on a count value of cycles of said tempo clock.

8. A performance data processing apparatus according to claim 7, further comprising:

means for forming automatic accompaniment data in synchronism with said tempo clock.

9. A performance data processing apparatus, comprising:

a keyboard;

pitch data storing means to store note pitch data based on key data generated during the period from depression to release of a key of said keyboard;

duration data generating means to generate duration data based on the duration of time said key is depressed and the duration of time said key is not depressed;

duration data storing means to store duration data generated by said duration data generating means; and note duration integrating means receiving two successive pitch and duration data pairs which are stored in said pitch data storing means and said duration data storing means, and combining the duration datum for the succeeding data pair with the duration datum for the preceding data pair to thereby provide an integrated note duration data to be combined with the pitch data for the preceding data pair, when the preceding data pair contains a pitch datum and the succeeding data pair does not contain a pitch datum, and the duration datum for the succeeding data pair is shorter than a predetermined duration.

10. A performance data processing apparatus according to claim 9, in which:

said pitch data storing means and said duration data storing means each comprises: pitch data temporary storing means and duration data temporary storing means; and performance data storing means for storing, in succession, note pitch data in said pitch data temporary storing means and duration data in said duration temporary storing means.

11. A performance data processing apparatus according to claim 10, in which:

said note duration integrating means comprises:

judging means for receiving successive pitch and duration data pairs, said pitch data for each data pair being stored in said pitch data temporary storing means, and for judging that the preceding data pair thereof contains pitch data and that the succeeding data pair thereof does not contain pitch data;

comparing means to compare, with the predetermined duration, duration data of said succeeding data pair among the duration data stored in the duration temporary storing means, and to deliver a comparison output when said duration data is shorter than said predetermined duration;

adding means to add a first and a second note duration data both having been stored in said duration data temporary storing means and corresponding to said preceding data pair and to said succeeding data pair, respectively;

selecting means operative so that, when outputs of said judging means and of said comparing means are both present, it outputs duration data from said adding means, and at other times it outputs duration data as it is delivered from said duration data temporary storing means; and shift register means for temporarily storing output data of said selecting means.

* * * * *